United States Patent [19]

Holmer

[11] Patent Number: 4,547,148

[45] Date of Patent: Oct. 15, 1985

[54] GAS-FIRED RADIANT BURNER

[75] Inventor: Larry G. Holmer, Woodstock, Ill.

[73] Assignee: Refractory Products Co., Elgin, Ill.

[21] Appl. No.: 666,043

[22] Filed: Oct. 29, 1984

[51] Int. Cl.[4] ..... F23D 13/12
[52] U.S. Cl. ..... 431/328
[58] Field of Search ..... 431/328, 329

[56] References Cited

U.S. PATENT DOCUMENTS 2,828,813 4/1958 Holden .
3,008,513 11/1961 Holden .
4,255,123 3/1981 Bishilany, III et al. .
4,290,746 9/1981 Smith .
4,354,823 10/1982 Buehl et al. .

*Primary Examiner*—Carroll B. Dority, Jr.

*Attorney, Agent, or Firm*—Fitch, Even, Tabin & Flannery

[57] ABSTRACT

A radiant gas-fired burner having a back plate for connection to a supply of air and gas which, together with a combined refractory fiber pad-metal support structure, defines a plenum for supply of a combustible air-gas mixture. A foraminous metallic member is embedded within a porous pad of refractory fibers and interlocked therewith. Lugs affixed to the rear surface of the metallic member afford connection to said back plate in a manner allowing easy detachment therefrom without dismounting said back plate from its operative position. The burner has a rectangular surface that is uniformly radiant which was formed by vacuum-forming a refractory fiber felt onto the foraminous member. Metal foil around the periphery of the pad prevents gas flow from escaping through the side edge.

9 Claims, 3 Drawing Figures

2.
15
13
27
69
61
11
21
53
33
23
67
65
73
71
45
77
43
47
49
29
19
17
31
55
57
63
41
37
39
51
59
25

GAS-FIRED RADIANT BURNER present invention relates to infrared radiant gas burners or heaters and more particularly to a radiant gas burner wherein the gas burner pad is made from ceramic fiber felt.

BACKGROUND OF THE INVENTION

Radiant gas-fired burners have been made for a number of years and are exemplified by U.S. Pat. Nos. 3,008,513, 3,785,763, 4,035,132 and 4,255,123. Such burners have included a board or pad of ceramic fibrous material to provide a permeable burning surface. Typically, these pads have been made from alumina-silica ceramic fibers, such as those sold under the trademarks Fiberfrax and Kaowool, or the like or from a blend of such fibers with fibers of other material having even greater refractory characteristics. In such a burner, a mixture of air and gas is fed to a distributing plenum from which it percolates through the permeable pad and burns on the exterior surface thereof, producing a glowing surface which is an excellent source of radiant energy. When such burners were made with a ceramic fibrous pad, one of the problems which existed was the difficulty of fastening the pad to the underlying structure, which constitutes the plenum, in such a manner that no exposed metal was left at the surface, while at the same time providing an easily replaceable pad. It was undesirable to have an exposed metal surface because one inherent and valuable property of this type of gas-fired radiant burner is the almost instantaneous cooling of the refractory pad after the gas flow is shut off, especially if air flow is permitted to continue. Accordingly, improved designs for such gas-fired burners have continued to be sought after.

SUMMARY OF THE INVENTION

The present invention provides a radiant gas-fired burner having a metal frame made of highly perforated steel, expanded metal or the like (hereinafter referred to as foraminous metal) which is structurally buried within and locked into a fibrous body which constitutes the refractory fiber pad. In other words, the pad of refractory fibrous material is formed by vacuum-forming from an aqueous slurry of refractory fibers and binder so that the water is withdrawn generally through the foraminous metal causing the fibers to be integrally locked through and in surrounding relationship about the foraminous metal frame. A plurality of lugs or stand-offs are affixed to the rear surface of the metal frame and provide points of support substantially equally spaced about the periphery to releasably secure the combination frame and pad to a rear plenum structure into which the air-gas mixture is supplied. Preferably, a seal of metallic foil or the like is placed around the periphery of the pad structure so as to deter the escape of the air-gas mixture through the sidewalls of the burner where its combustion would be less efficient than on the front radiant face. The front face of the burner pad is rectangular in shape allowing a plurality of such burners to be placed in juxtaposition with one another to create a composite burner of essentially continuous surface because there is no apparent gap or joint between the radiant surfaces of adjacent burners. Accordingly, the construction of very large burning faces, which will be extremely efficient in their operation, can be created.

DETAILED DESCRIPTION OF THE PREFERRED EMBODIMENTS

Figures 1, 2, 3:
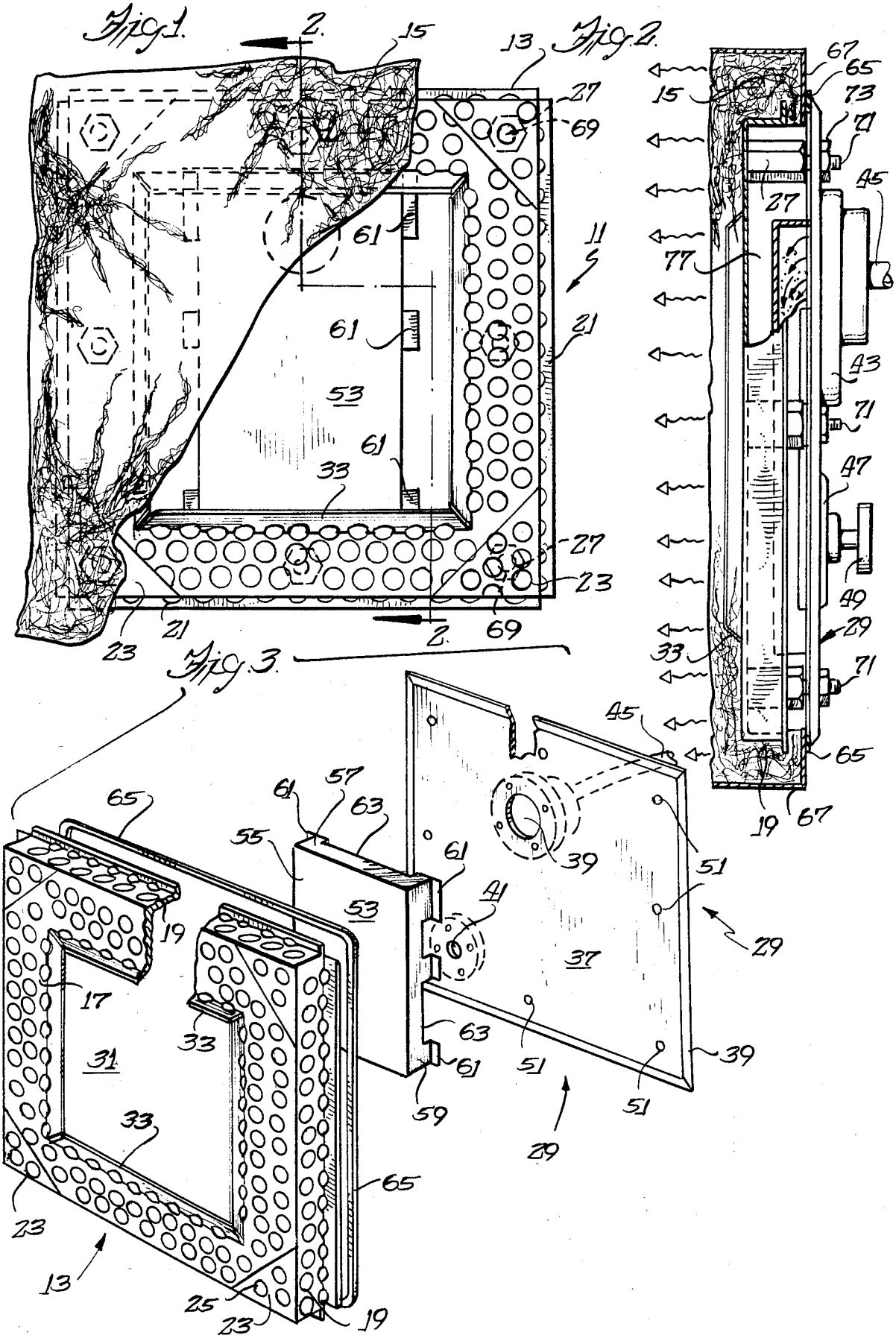
FIG. 1 is a front view of a radiant gas-fired burner embodying various features of the invention having portions broken away so as to better illustrate the frame and plenum structures.
FIG. 2 is a side sectional view, enlarged in size, taken generally along the line 2—2 of FIG. 1.
FIG. 3 is an expanded perspective view showing the various portions of the radiant burner of FIG. 1 with the fibrous pad omitted so as to better illustrate the construction of the foraminous frame.

A radiant burner 11 is illustrated in the drawings which illustrates various features of the invention and includes a foraminous metal frame 13 which supports and carries a surrounding refractory fibrous pad 15. The frame 13 is formed from foraminous metal, for example, highly perforated steel sheet, e.g., about 0.035 inch thick, or expanded metal, preferably steel, which will retain its structural strength at the relatively high temperature environment in which it will be exposed as a part of a radiant burner. The pad 15 is formed from refractory-grade fibers, such as fibers of alumina-silica material, e.g., those sold under the trademarks Fiberfrax, Kaowool or the like, joined together with a suitable inorganic refractory binder, or a blend of these fibers together with fibers having even more refractory characteristics, e.g., alumina fibers sold under the trademark Saffill, may be used.

The illustrated frame 13 is generally rectangular, e.g., square, in its major dimension as depicted in FIG. 1. The frame is preferably die cut from a sheet of foraminous material and then formed into the shape of a shallow pan so that it includes a planar main wall 17 which is square in outline from which four sidewalls 19 are bent extending rearward at substantially right angles thereto. To provide additional rigidity to the structure, the sidewalls may be tack-welded or otherwise suitably secured along their adjacent edges to complete the shallow pan-like structure. Each of the sidewalls terminates in an outwardly bent side flange 21 which in turn extends at substantially right angles to the sidewall. If desired to further increase the rigidity of the frame, four triangular gussets 23 may be located at the four corners of the main wall. The gussets 23 may be suitably affixed, as by tack-welding or the like to either the front surface or the rear surface of the main wall. The gussets may be made from slightly heavier gauge steel and are preferably also perforated with holes 25 to facilitate the felting operation. The gussets 23 provide additional support in the four corners for the attachment of four of the eight lugs 27, described in more detail hereinafter, Which extend rearward from the rear surface of the main wall 17 and allow easy connection of the pad assembly to a back plate assembly 29 that, together with the pad assembly, defines the plenum. The periphery of the frame 13 generally provides its structural strength, and a large square opening 31 is provided in the center of the frame. The opening 31 is defined by four central flanges which are bent forward from the front face at an angle of between about 30° and 60°, preferably about 45°. As seen in FIG. 2, these flanges 33 become totally embedded within the refractory fibrous pad, securely locking the frame and the pad to each other.

The frame 13 is prefabricated and is then loaded onto a suitable die for use in a vacuum-forming operation to create the frame pad combination. The vacuum-forming felting operation can be carried out as disclosed in U.S. Pat. No. 4,122,644, issued Oct. 31, 1978, the disclosure of which is incorporated herein by reference. More specifically, the frame 13 is disposed within a felting box having the desired peripheral dimensions of the finished pad. A central insert is provided upon which the rear face of the main wall 17 lies, and this central insert is of such height that the sidewall flanges 21 are spaced a short distance above the bottom felting screen. A slurry of refractory fiber particles, water and a colloidal inorganic binder, such as colloidal silica, is then supplied to the felting box, and either suction or pressure is applied to cause the water to drain downward through the screen thereby depositing fibers on the screen to build up a layered mat of the desired thickness. Because of the disposition of the felting screen portions below the inclined flanges 33 and the sidewall flanges 21, the fibrous mat wraps around these flanges assuring interlocking of the ultimate pad and the frame at these points. In addition, individual fibers protrude through or become entangled with the expanded metal or perforated steel structure at the myriad of openings therethrough and assure that there is attachment of the mat to the frame across substantially its entire surface.

After a mat of the desired thickness has been built up, sufficient of the inorganic binder remains with the still wet fibers to rigidly interconnect the fibers at their points of contact with one another following evaporation of the remainder of the water during firing of the refractory fiber mat-frame combination. Drying is carried out in any suitable manner, and usually a circulating hot-air oven is used which is operated at a temperature between about 300° and 600° F. Generally, colloidal silica is used as the binder; however, other colloidal inorganic oxides may be used. Upon removal of the water, the colloidal silica creates a strong inorganic bond between the refractory fibers at the points of intersection where one fiber is in touching contact with another.

The back plate assembly 29 includes a generally square back plate 37 having a peripheral flange 39 that is bent forward at about a 45° angle, a relatively large entrance hole 39 and a smaller hole 41. Suitably secured to the rear surface of the back plate 37, in surrounding relation to the large hole 39, is a fitting 43 to which there is attached a pipe 45 which supplies the air-gas mixture to the burner. Suitably attached to the rear surface of the back plate in the region of the smaller hole 41 is a fitting 47 which carries a pressure gauge 49 for constantly reading the gas-air pressure within the plenum. There are eight additional holes 51 provided in the back plate at locations substantially equally spaced about the periphery to facilitate interconnection of the backplate assembly 29, and the frame-pad combined structure is described in detail hereinafter.

Suitably affixed to the front surface of the backplate 37 is a distribution chamber 53 which is in the form of a shallow tray-like structure with its open side being located adjacent the front surface of the backplate 37. The chamber 53 has a main impervious wall 55, a pair of slotted end walls 57 and a pair of slotted side walls 59. Tabs 61 bent outward at right angles from the edges of the slotted side walls 59 are suitably affixed, as by welding, to the front surface of the backplate. The air-gas mixture applied to the fitting 43 at the rear of the backplate enters through the opening 39 and fills the distribution chamber 53 exiting via the slots 63 provided in the slotted end and side walls 57,59. Thus, the distribution chamber assures that there is spreading of the air-gas mixture throughout the burner plenum and equalizes distribution across the face of the radiant burner.

To assure that the air-gas mixture is directed through the front face of the pad, a peripheral gasket 65 is provided which seals the junction between the back plate peripheral flange 39 and the pad-frame structure. An impervious metal foil seal 67 is preferably provided about the entire periphery of the square pad 15. The gasket 65 is made of suitable high-temperature resistant material, such as an appropriately formulated silicone rubber, and the foil seal 67 is formed from aluminum or other suitable metallic foil having a thickness of at least about 0.005 inch. As best seen in FIG. 2, the foil seal extends around the entire outer periphery of the square pad and then extends inward along the rear face of the pad.

To facilitate the interconnection between the pad-plate combination and the back plate assembly, an appropriate number of substantially evenly spaced lugs 27, which as illustrated are hexagonal in exterior cross section, are located around the periphery and extend rearward from the rear surface of the main wall 17 of the frame. Each of the lugs is provided with a threaded interior passageway 69 which accepts a threaded stud 71 that protrudes from the rear surface thereof. In assembling the overall burner, the back plate assembly is aligned with the stud-containing pad-frame structure, with the gasket 65 disposed therebetween. The eight threaded studs 71 are positioned so they protrude through the eight holes in the back plate, and eight nuts 73 are installed and tightened so as to secure the gasket 65 in sealing position between the edge of the peripheral flange 39 and the foil seal 67 on the rear surface of the pad 15. In the ultimate assembled structure, an interior plenum 77 is provided between the front surface of the back plate assembly 29 and the rear surface of the main section of the pad 15 and the associated main wall 17 of the frame. The distribution chamber 53 is located in this plenum 77.

The assembled burner can be mounted in its operative location using a rigid gas supply pipe 45. Alternatively, brackets (not shown) can be attached to the rear surface of the back plate 37 to assist in substantially permanent mounting of the rear plate assembly 29. When the air-gas mixture is supplied through the pipe 45 and the entrance opening 39, it is distributed throughout the plenum 77 as it flows through the slots 63 in the distribution chamber, and the pressure in the plenum is readable by the pressure gauge 49. The gas-air mixture percolates through the refractory fibrous felted pad 15 until it reaches the front surface of the pad. A suitable electric igniter (not shown), as known in the art, is preferably provided which causes the ignition of combustion generally at the front surface of the pad where burning then occurs. The refractory fiberous pad is heated to a high temperature as a result of the combustion and a large amount of radiant heat is created.

Because of the overall construction of the radiant burner 11, there is percolation throughout the fibrous pad, and burning occurs substantially uniformly across the entire square front face of the pad. Thus, the radiant surface extends to the outer edge of the square pad, allowing several of these pads to be placed side-by-side with no apparent joint or gap in the radiant surface between juxtaposed pads. This feature allows the construction of a very large and efficient burning face, as well as allowing the efficient achieving of lower rates of heating by selectively turning off certain of the burners and operating with only a selected pattern of such burners. Because there is no metal exposed to the highest temperature portions of the burner at the front face of the pad, there is no need to provide a separate flow of cooling air to retain the integrity of such a supporting metal part, such as is needed in other burners that have been heretofore employed. Moreover, upon termination of the heating by cutting off the flow of gas, and preferably maintaining some flow of air, extremely rapid cool-down of the exposed surfaces occurs because the thermal mass of the refractory fiber material is quite low and cools rapidly.

The overall construction greatly facilitates replacement of the pad-frame structure after its useful lifetime has been reached. Instead of having to disconnect the entire burner, one need only to remove the nuts 73 from the ends of the threaded studs 71, thereby releasing the pad-frame structure and replace it with a new structure of the same size and shape. After tightening the nuts so that the gasket 65 seals the joinder between the new structure and the back plate assembly 29, the burner is ready to resume operation.

Although the invention has been described with respect to a preferred embodiment, it should be understood that various changes and modifications as would be obvious to one having the ordinary skill in the art may be made without departing from the invention which is defined in the appended claims. For example, if the radiant gas burner was intended to be used by itself, it might be desired to wrap a layer of fibrous insulation about the periphery of the back plate or even across a major portion of the back plate to protect it from heat that might otherwise be directed toward it from adjacent burners that although spaced from it form part of the overall environment. Particular features of the invention are emphasized in the claims which follow.

What is claimed is:

1. A radiant gas-fired burner comprising a back plate, the front face of which is constructed to partially define a plenum for supplying a combustible air-gas mixture, and the rear face of which includes means for connection to a supply of air and gas, a combined refractory fiber pad-metal support structure including a foraminous metallic member which is embedded within a porous pad of refractory fibers, said fiber pad and said foraminous metallic member being interlocked with each other, said metallic member having lugs affixed to a rear surface thereof and means for connection to said lugs to join said back plate and said combined structure into assembled condition, with said plenum located generally adjacent the rear surface of said porous refractory fiber pad.

2. A burner in accordance with claim 1 wherein said lugs and said connection means include threaded interengaging means whereby said combined structure can be easily detached from said back plate without dismounting said back plate from its operative position.

3. A burner in accordance with claim 1 wherein a main wall portion of said metallic member has a generally rectangular outline and four sidewalls extending rearwardly from each edge thereof.

4. A burner in accordance with claim 3 wherein said back plate includes a diffuser structure affixed to the front surface thereof which constitutes said plenum, said diffuser having a generally imperforate front face and having a side wall with gas passageway means provided therein.

5. A burner in accordance with claim 4 wherein the length of said lug means is greater than the height of said diffuser side wall so that a substantial portion of said plenum lies between said diffuser imperforate wall and the rear face of said combined structure.

6. A burner in accordance with claim 5 wherein the dimensions of said diffuser are such that said plenum also surrounds said diffuser sidewall.

7. A burner in accordance with claim 3 wherein side flanges extend outwardly from the edges of said sidewalls and said pad of refractory fibers wraps around said side flanges contributing to the interlocking of said pad and said metallic member.

8. A burner in accordance with claim 3 wherein a central opening is provided in said main wall portion which is provided with flanges extending forWard out of the plane thereof at an angle between about 30° and 60° that frame said opening.

9. A burner in accordance with claim 1 wherein gas-impervious material is disposed in surrounding relationship to the side edge periphery of said pad to restrict the percolating air-gas mixture to the front surface of said pad.

* * * * *